US007152856B2

(12) United States Patent
Kamiya et al.

(10) Patent No.: US 7,152,856 B2
(45) Date of Patent: Dec. 26, 2006

(54) SHEET PROCESSING APPARATUS AND IMAGE PROCESSING APPARATUS

(75) Inventors: Daisaku Kamiya, Abiko (JP); Masaharu Nemura, Toride (JP); Junichi Moteki, Abiko (JP); Yuzo Matsumoto, Toride (JP); Shunsuke Nishimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 10/987,007

(22) Filed: Nov. 15, 2004

(65) Prior Publication Data

US 2005/0104269 A1 May 19, 2005

(30) Foreign Application Priority Data

Nov. 17, 2003 (JP) ..... 2003-386395
Nov. 17, 2003 (JP) ..... 2003-386397

(51) Int. Cl.
*B31F 1/10* (2006.01)

(52) U.S. Cl. ..... 270/37; 270/32; 270/39.06; 270/39.07; 270/39.08; 493/444; 493/445

(58) Field of Classification Search ..... 270/32, 270/37, 39.06, 39.07, 39.08; 493/444, 445
See application file for complete search history.

(56) References Cited

U.S. PATENT DOCUMENTS 4,985,013 A * 1/1991 van der Werff et al. .... 493/444
5,274,399 A 12/1993 Uchida et al. ..... 346/134
5,535,012 A 7/1996 Matsumoto et al. ..... 358/400
5,580,045 A 12/1996 Matsumoto et al. ..... 271/298
6,021,305 A 2/2000 Sato et al. ..... 399/374
6,131,898 A 10/2000 Hiroi et al. ..... 271/10.03
6,246,491 B1 6/2001 Matsumoto et al. ..... 358/468
6,251,054 B1 * 6/2001 Cruz et al. ..... 493/383
6,371,471 B1 * 4/2002 Fukazu et al. ..... 270/58.09
6,398,214 B1 6/2002 Moteki et al. ..... 271/220
6,471,429 B1 10/2002 Isobe et al. ..... 400/582
6,671,491 B1 12/2003 Yamanaka et al. ..... 399/407
6,817,605 B1 * 11/2004 Bohn ..... 270/37
6,826,374 B1 11/2004 Kato et al. ..... 399/16
6,845,228 B1 1/2005 Suzuki et al. ..... 399/407
2003/0094745 A1 * 5/2003 Kitahara ..... 270/58.08
2003/0155699 A1 * 8/2003 Tamura et al. ..... 270/52.01
2003/0214090 A1 11/2003 Kato et al. ..... 270/12
2003/0222391 A1 12/2003 Iwama ..... 271/1
2004/0021266 A1 2/2004 Mizuta et al. ..... 271/303
2004/0022564 A1 2/2004 Fujil et al. ..... 399/382
2004/0096254 A1 5/2004 Sato et al. ..... 399/405
2004/0178572 A1 9/2004 Nishimura et al. ..... 271/298
2004/0212136 A1 * 10/2004 Yoshino ..... 270/58.08

* cited by examiner

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

The present invention relates to a sheet processor apparatus comprising: a sheet stack portion on which a sheet is stacked; a sheet conveyance path for conveying a sheet stacked on the sheet stack portion; a sheet conveyor for conveying to the sheet conveyance path the sheet stacked on the sheet stack portion; and a sheet folding device for folding a sheet in the sheet-set conveyance path. The sheet folding device is provided in the sheet conveyance path, and at least a portion of the sheet conveyance path at which the sheet folding device is positioned is formed into a curved shape.

5 Claims, 13 Drawing Sheets

(a)

(b)

(c)

SHEET PROCESSING APPARATUS AND IMAGE PROCESSING APPARATUS

BACKGROUND OF THE INVENTION

1. Field of the Invention

The present invention relates to a sheet processing apparatus and an image forming apparatus such as a copier, printer, or facsimile machine, or combinations thereof "combined apparatus", hereafter) having the sheet processing apparatus mounted in a mainbody of its own and for performing image forming.

2. Related Background Art

FIG. 13 shows a conventional sheet processing apparatus that performs a processes, such as folding process and a binding process, of a sheet on which an image is formed in an image forming apparatus (see Japanese Unexamined Patent Application Publication No. 2003-095519). As shown in the drawing figure, a sheet processing apparatus 503 is disposed on the side of a main body of an image forming apparatus 501. The image forming apparatus 501, shown in FIG. 13, has an image reader 502 above the image forming apparatus 501.

In the sheet processing apparatus 503, sheets each having an image formed in the main body of the image forming apparatus 501 on a single side or double sides are serially taken in, and various processes are appropriately performed corresponding to setting. The processes include, for example, a folding process for folding a set of sheets (or, a "sheet set", hereafter) in two ("bi-folding", hereafter), and a single-side binding process for performing binding of edge of the sheet. For example, in the folding process for performing bi-folding of a set of sheets, the sheets serially taken in, as described above, are serially stacked on a saddle tray 504 formed substantially straight with a steep tilt and disposed substantially in a vertical direction, and are aligned into a set of the sheets. The sheet set is stapled using a stapling unit 505 substantially along the center portion of the sheet set. Then, the saddle tray 504 is moved to a binding portion (binding position) of the sheet set at the position of a folding device shown at numerals 506 and 507. The sheet set is folded there by the folding device shown at numerals 506, 507 in two, and concurrently, ejected onto a stack tray 508.

In the conventional sheet processing apparatus 503 described above, the folding device, which double-folds a sheet set, is configured of components, such as a folding roller pair 506 (i.e. a pair of rollers) and a push-out mechanism formed of a pushing plate 507 and the like. The binding position of the sheet set is pushed by the pushing plate 507, and the sheet set is folded to a nip of the folding roller pair 506. Then, the folded sheet set is pinched and carried by the folding roller pair 506, and concurrently, is bi-folded. Thereby, the sheet set is folded by the stapling unit 505 along the binding position in the center of sheet set, and is ejected in a book-bound form to the stack tray 508.

When performing the single-side binding process for edges of the sheet set, the conventional sheet processing apparatus 503, the sheets serially taken in the above-described manner, aligned into the form of the sheet set by being serially stacked over a processing tray 509 disposed substantially in a horizontal direction with a predetermined tilt. Edges of the sheet set (one corner portion or multiple edge portions) are stapled by a stapling unit 510, and the stapled sheet set is ejected onto a staple tray 511. In a mode of not performing the binding process or the folding process, sheets are ejected and stacked onto a stack tray 512.

However, the sheet processing apparatus 503 is provided on the side face of the mainbody of the image forming apparatus 503, so that the overall apparatus width, that is, the total inclusive of the added width of the sheet processing apparatus is increased, whereby requiring an increased installation occupation area for installation of the overall apparatus.

In addition, a large space in the apparatus height direction is required for the conventional sheet processing apparatus 503 since the saddle tray 504 is formed substantially straight with the steep tilt and is disposed substantially in a vertical direction. Further, since not only that the saddle tray 504 is disposed substantially straight with the sharp angle, but also that the pushing plate 507 operates in the direction substantially perpendicular to the saddle tray 504, whereby causing ineffective use of spacing.

Further, in the conventional sheet processing apparatus 503, the pushing plate 507 performs the folding process, and the processing tray 509 performs the single-side binding process. Thus, the configuration is such that the processes are performed by the different processing trays, therefore requiring corresponding spacing and costs.

Further, in the conventional sheet processing apparatus 503, the pushing plate 507 is formed into the shape of a tray extending in the substantially vertical direction. As such, a large force is required for the pushing plate 507 to fold a sheet set being stacked above the pushing plate 507 to be substantially straight along the substantially vertical direction. This leads to, for example, an increase in the size of a driving source for the pushing plate 507 and an increase in cost.

SUMMARY OF THE INVENTION

The present invention is made in view of the problems described above. Accordingly, an object of the invention is to provide a sheet processing apparatus designed to implement miniaturization, space saving and lower cost. Another object of the invention is to provide an image forming apparatus.

In order to achieve the above-described objects, a representative configuration of the present invention comprises a sheet stack portion on which a sheet(s) is stacked; a sheet conveyance path which conveys a sheet set stacked on the sheet stack portion; a sheet conveyor which conveys to the sheet conveyance path the sheet stacked on the sheet stack portion; and a sheet folding device which performs a sheet in the sheet conveyance path. The sheet folding device is provided in the sheet conveyance path; and at least a portion of the sheet conveyance path at which the sheet folding device is positioned is formed into an curved shape.

DETAILED DESCRIPTION OF THE PREFERRED EMBODIMENTS

Preferred embodiments of the invention will be exemplified and described in detail herebelow with reference to the accompanying drawings. The scope and ranges of invention are not intended to be limited to factors such as dimensions, materials, shapes, and relative dispositions thereof described in the embodiments. These factors are rather to be appropriately changed depending on configurations, various conditions, and the like factors of apparatuses and/or devices to which the invention is adapted.

(First Embodiment)

Figure 1:
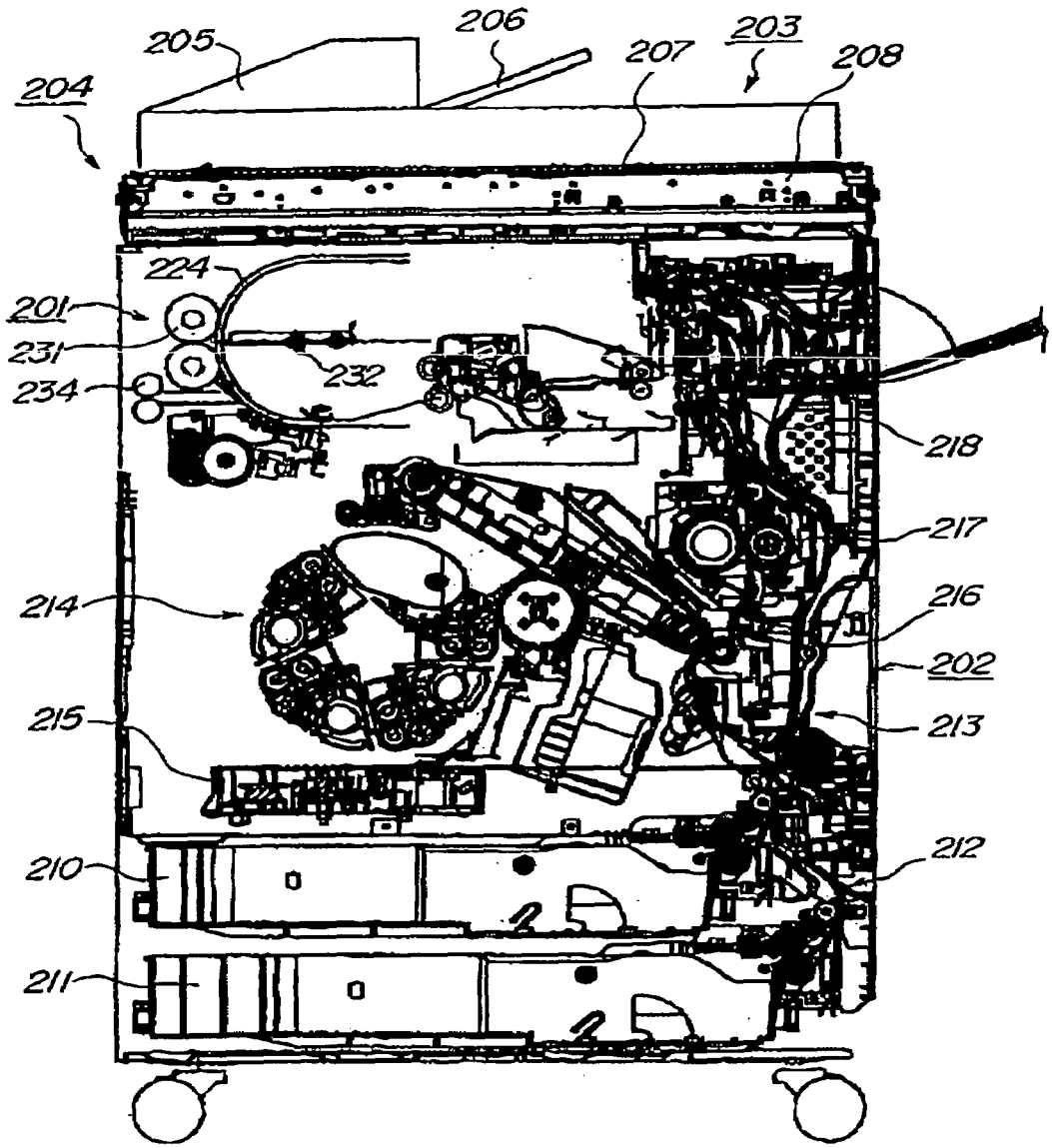
FIG. 1 is an overall front cross section of an image processing according to a first embodiment of the invention.
Figure 2:
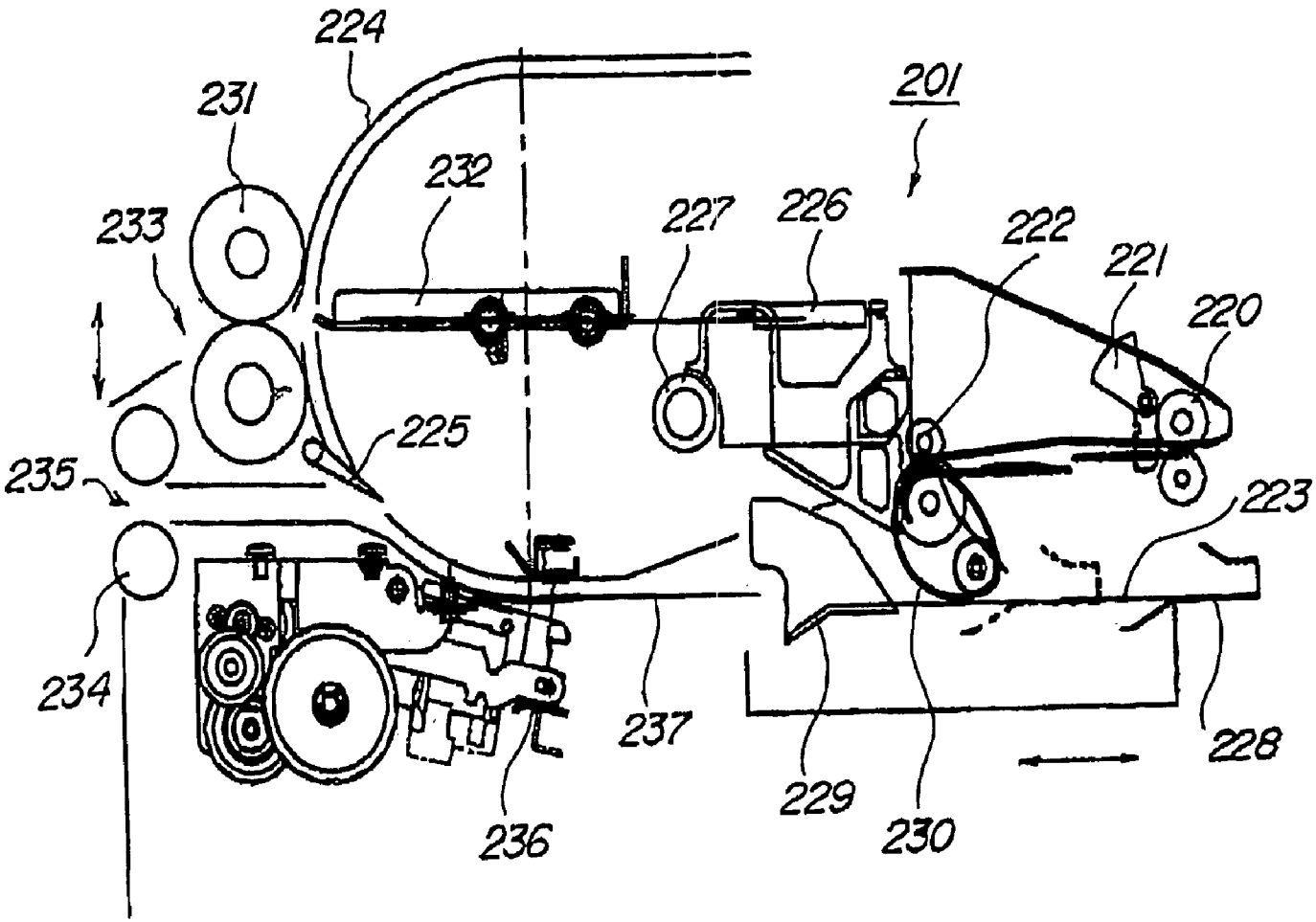
FIG. 2 is a schematic front cross section of a sheet processing apparatus according to the first embodiment of the invention.

Referring to the drawings, the following will provide a description by exemplifying a sheet processing apparatus and a copier as being one example of the image forming apparatus having the sheet processing apparatus in a mainbody of its own, according to a first embodiment of the present invention. FIG. 1 is an overall front cross section of an image processing apparatus; FIG. 2 is a schematic front cross section of the sheet processing apparatus; FIGS. 3A to 3D are views descriptive of operation of a folding process; and FIGS. 4A to 4C are views descriptive of operation of a stapling process of the sheet processing apparatus.

Referring to FIG. 1, numeral 204 denotes a copier as being an image processing apparatus. In the copier 204, a printer portion 202 having an image forming portion is disposed in a lower portion, a sheet processing apparatus 201 is disposed in an upper portion, and a scanner portion 203 having an image reading portion is disposed above the sheet processing apparatus 201. Thus, the sheet processing apparatus 201 is disposed above the printer portion 202 and below the scanner portion 203.

The scanner portion 203 is provided with a readout sheet feeder 205. An original sheet set on an original-sheet tray 206 is conveyed to an original-sheet readout position on an original-sheet platen glass 207, and the original sheet is read out by an optical system 208. An image having been read out is conveyed to the printer portion 202.

Below the printer portion 202, there are mounted a plurality of sheet stock portions 210 and 211 on which, for example, sheets of different sizes are stacked, and a sheet feeding portion 212 for feeding one sheet at a time from sheets stacked on the sheet stock portions 210 and 211. A sheet fed by the sheet feeding portion 212 is conveyed to an image forming portion 214 through a sheet conveyance path 213. In a laser scanner 215, laser light is scanned in accordance with image information read out by the optical system 208 of the scanner portion 203, and a latent image (toner image) is formed onto a photoreceptor belt 216 (photoreceptor drum, depending on the case) of the image forming portion 214. The toner image thus formed on the photoreceptor belt 216 is transferred onto a sheet, and the sheet is conveyed by a conveyance roller pair 218 to the sheet processing apparatus through a transfix member 217 that causes a toner image on a sheet to be plastically fused and transfixed to the sheet.

As shown in FIG. 2, in the sheet processing apparatus 201, the sheet conveyed from the printer portion 202 is accepted by an entry roller pair 220 and is then conveyed to a conveyance roller pair 222. A sheet detection sensor 221 for detecting the passing of the sheet in transit is provided near the entry roller pair 220. In this case, control is performed such that when the sheet tail edge is being passed through the sheet detection sensor 221, the sheet is ejected at a predetermined velocity from the conveyance roller pair 222. The ejected sheet is stacked on a processing tray 223 serving as a sheet stack portion, which allows a predetermined number of sheets to be stacked, and is aligned. A sheet set aligned undergoes post-processes, such as the folding process and the stapling process, and is then ejected from a first sheet-set ejection port 233 or a second sheet-set ejection port 235 that are provided on a same sidewall side of the apparatus mainbody.

(Operation of Folding Process)

Operation of the folding process of the sheet processing apparatus 201 will be described herebelow with reference to FIGS. 2 and 3A to 3D. The folding process is a process that performs stapling in a conveyance-direction central position of a sheet set, and performing folding of the sheet set along the central position in two (or, bi-folding the sheet set along the central position). A saddle unit for performing the folding process is configured primarily of an curved path 224 and a straight path 237 that constitute a sheet-set conveyance path; and a folding roller pair 231 and a pushing plate 232 that constitute a sheet-set folding device.

Figure 3:
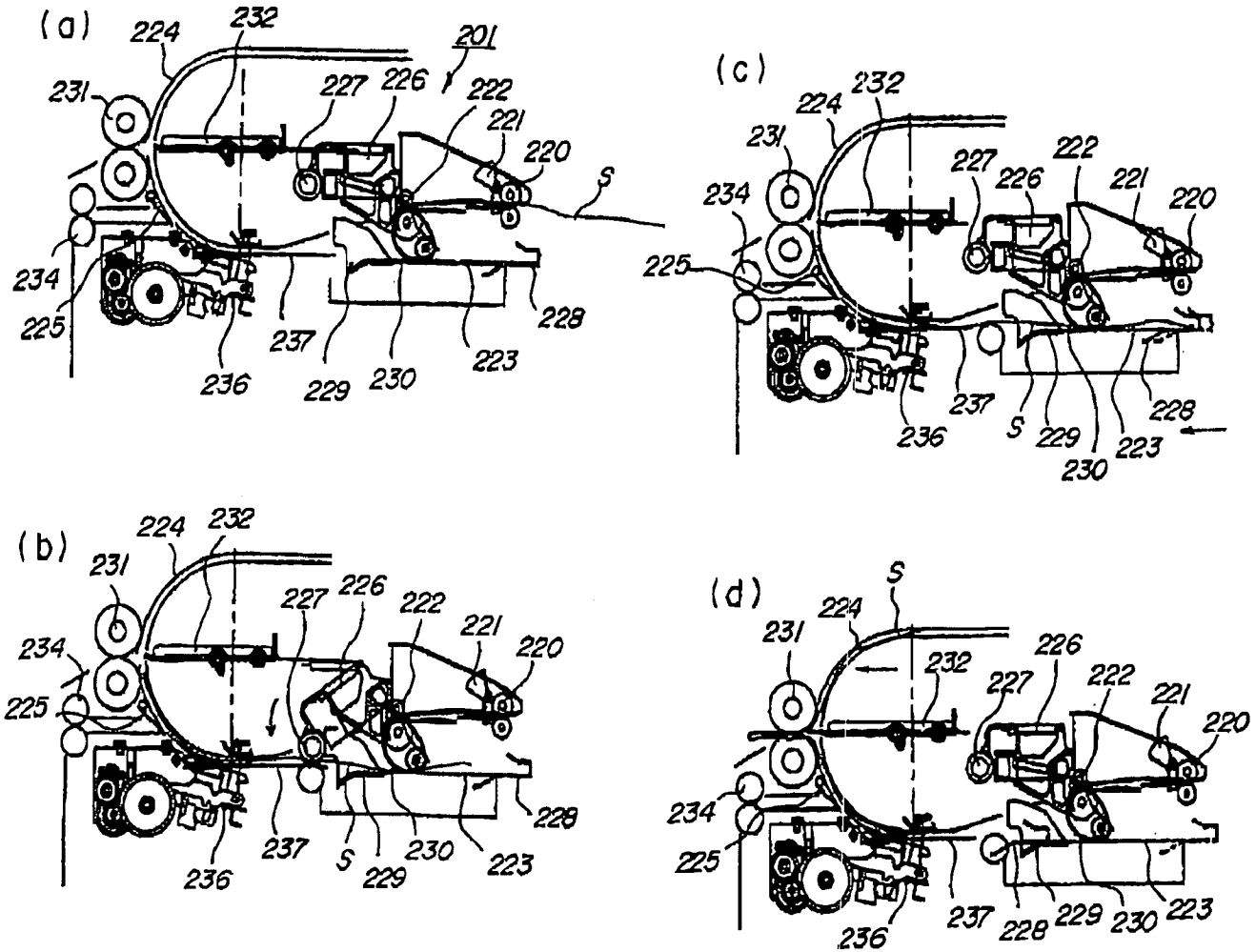
FIGS. 3A to 3D are views descriptive of operation of a folding process of the sheet processing apparatus according to the first embodiment of the invention.

With reference to FIG. 3A, a sheet S conveyed to the sheet processing apparatus 201 is ejected onto the processing tray 223, which is formed substantially horizontal and straight, when the tail edge of the sheet S passes away from the conveyance roller pair 222. In the folding process, a switching flapper 225 rotatably supported is moved by a driving means (solenoid or the like) to the reposition shown in each of FIGS. 3A to 3D before the sheet S is ejected onto the processing tray 223. The switching flapper 225 constitutes a switching member and switchably moves to guide the sheet set to a first sheet-set ejection path (constituted of the curved path 224, the folding roller pair 231, and the first sheet-set ejection port 233) that ejects a sheet set having undergone the folding process of the sheet-set folding device. Alternately, the switching flapper 225 switchably moves to guide a sheet set to a second sheet-set ejection path (constituted of the curved path 224, a first sheet-set ejection roller pair 234, and the second sheet-set ejection port 235) that ejects a sheet set that does not undergo the folding process of the sheet-set folding device. In addition, depending on the mode, the switching flapper 225 switchably moves to guide a leading edge of a sheet (particularly, a large paper sheet) being ejected onto the processing tray 223 to either the first sheet-set ejection roller pair 234 or the second sheet-set ejection port 235.

Then, with reference to FIG. 3B, a pivotal arm 226 with one end being rotatably supported pivotally moves in the lower direction. The sheet is moved by a return roller 227 rotatably supported by the pivotal arm 226 along the direction of a rear end stopper 228. The sheet S is conveyed by a return belt 230 until it abuts the rear end stopper 228. The return belt 230 slips on the upper face of the sheet S, whereby the alignment operation in the sheet conveyance direction is once terminated. Then, with an aligning plate 229 (which may be provided in two, front and inner portions) movable in a front-inner direction as viewed in the drawing, alignment of the sheet in the front-inner direction is carried out. On this occasion, when the processing tray 223 is substantially horizontal, a case can occur in which the sheet is tilted in alignment by the aligning plate 229, so that the sheet alignment in the conveyance direction is again carried out by the return belt 230. In this manner, sheet-set alignment terminates.

Upon termination of the sheet-set alignment as described above, as shown in FIG. 3C the rear end stopper 228 is moved by moving means (not shown) in the conveyance direction (arrow-indicating direction), whereby the sheet set (indicated by symbol S) is moved by a predetermined amount. Thus, the rear end stopper 228 concurrently constitutes a sheet-set conveyor. Then, the sheet set is stapled by a stapling unit 236 along a central position (binding position). The stapling unit 236 is formed separated into a stapling portion and a clincher portion that clinches staple legs, and is disposed with a sheet-set conveyance path being interposed therebetween. Two stapling units 236 are disposed (shown overlapped in the drawing) in positions left-right symmetric with respect to a sheet-width-direction center. The sheet set is bound by being stapled at two portions along the sheet central position. The respective stapling unit 236 is supported movably in the front-inner direction as viewed in the drawing, and is placed in a standby state corresponding to the sheet size. Thus, the respective stapling unit 236 is disposed above the printer portion 202 and inside of the image forming portion 214, so that the reduction in the installation occupation area of the overall apparatus can be implemented, and concurrently, the intra-apparatus space can be efficiently used.

Subsequently, as shown in FIG. 3D, the rear end stopper 228 is further moved by the moving means (not shown) in the left direction as viewed in the drawing. Thereby, the sheet set S is carried to an upper portion from a lower portion (i.e., vertically upward) along the curved path 224 formed into a predetermined arc shape. More specifically, the curved path 224 refers to a path formed either into a substantially semicircular shape with a predetermined radius R or into a substantially U-turn shape state similar to the substantially semicircular shape. The sheet set is moved such that the binding position of the sheet set opposes a nip position of the folding roller pair 231. Upon termination of the movement, pushing-plate moving means (solenoid or the like) (not shown) is operated. Thereby, the central portion (binding position) of the sheet set is pushed by the pushing plate 232 in the direction of the folding roller pair 231 (in the arrow-indicating direction). The pushing plate 232 is disposed perpendicular to a tangential line of a predetermined circular arc of the curved path 224. Then, a folding motor (not shown), and the sheet set is nipped and pinch-conveyed by the folding roller pair 231 to be bi-folded along the binding position. Thereby, the sheet set is bi-folded along the central binding position in the sheet length direction. The sheet set having undergone the folding process ("folding-processed", hereafter) is ejected by the folding roller pair 231 from the first sheet-set ejection port 233. Thus, since the configuration wherein the pushing plate 232 is disposed inside of the curved path 224, the apparatus can be miniaturized and hence the installation occupation area can be reduced in comparison to the case where the pushing plate is provided to the conventional substantially vertical saddle tray.

In this case, the circular arc of the curved path 224 is set to $\pi R \geqq L$ (L=length of the bi-folded sheet S in the sheet conveyance direction), and the length of a straight portion of the processing tray is set to $L2 \geqq L$. The sheet length prior to the bi-fold bookbinding is expressed as $2L(2\times L)$. These settings make it possible to prevent a sheet leading edge from being bowed down during sheet alignment and to implement improved alignment. While the conditions described above are preferred, but no limitations are imposed thereto.

In addition, a sheet set is aligned on the processing tray 223, which has the substantially horizontal straight shape, and is pushed by the rear end stopper 228 thereby to be carried vertically upward. This enables preventing a intra-sheet-set misalignment from occurring when the sheet set is carried by a roller pair. For example, a diagonal misalignment can be prevented that occurs when a central sheet of the sheet set advances faster than other ones. In addition, the sheet set is carried vertically upward, whereby the sheet-set tail edge is always brought by the sheet-set dead weight into abutment with the rear end stopper 228. Consequently, stapling can be performed in a state where the sheet-set alignment is not broken. Thus, the alignment is achieved by using the processing tray 223 having the substantially horizontal straight shape, and the sheet-set is conveyed by being carried vertically upward along the curved path 224, whereby an urging force occurring from the sheet-set dead weight is obtained. This makes it possible to efficiently implement a compromise of space saving (reduction in the installation occupation area) and securing of alignment.

Further, the folding position (position to be pushed by the pushing plate 232) is set to the portion on the curved path 224. Accordingly, the sheet set is bent curvedly in the folding direction and is provided with a preliminary folding pattern, consequently making the sheet set easily foldable.

(Operation of Stapling Process)

Figure 4:
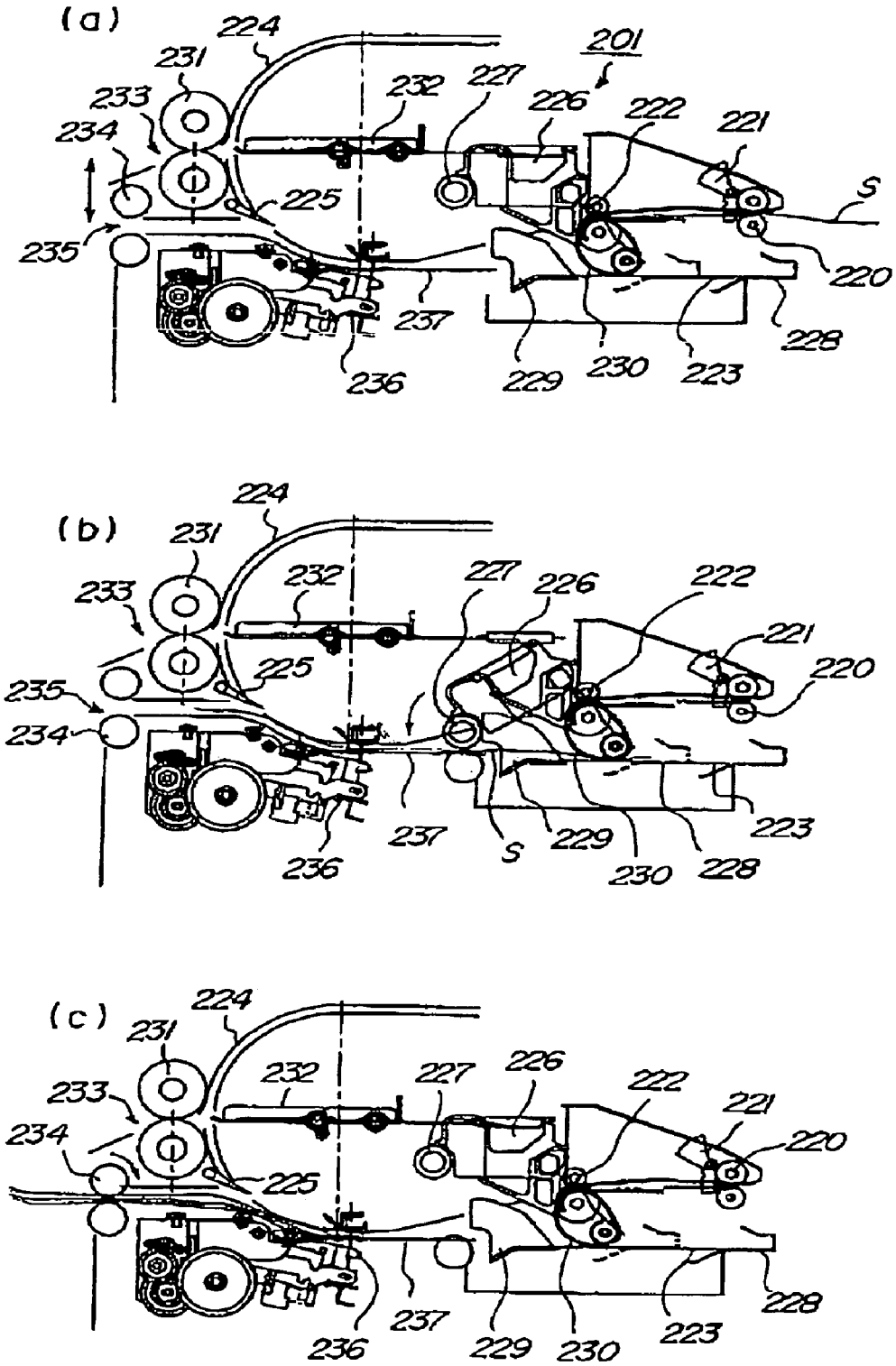
FIGS. 4A to 4C are views descriptive of operation of a stapling process of the sheet processing apparatus according to the first embodiment of the invention.

Operation of the stapling process of the sheet processing apparatus 201 will be described herebelow with reference to FIG. 4. The stapling process is defined to perform only stapling and not to perform the folding process.

Also when performing the stapling process, as in the stapling process, at the outset a sheet is aligned on the processing tray 223 (see FIGS. 3A and 3B). The alignment operation in this event is substantially the same as the alignment operation in the event of the folding process. A difference is that before sheet ejection onto the processing tray 223, as shown in FIGS. 4A to 4C a sheet set is moved to a position of guiding to the second sheet-set ejection path (the curved path 224, the first sheet-set ejection roller pair 234, then the second sheet-set ejection port 235), and the first sheet-set ejection roller pair 234 is detached. Another difference is that, as shown in FIGS. 4A to 4C, in order to improve productivity by reducing the sheet-set conveyance distance for the rear end stopper 228, the rear end stopper 228 is preliminarily moved to a predetermined position proximate to the return belt 230.

Upon termination of the sheet set alignment, as shown in FIG. 4C the sheet set is carried by the rear end stopper 228 to a predetermined position, stapling is performed by the stapling unit 236. In the case where the folding process is performed, stapling is performed in the central portion of the sheet set. However, cases where the folding process is not performed are mostly dominated by cases where stapling is performed at a sheet end portion, so that the process is termed an "end-portion binding process" The sheet set having thus undergone the stapling process ("stapling-processed", hereafter) is compressed (pinched) by the first sheet-set ejection roller pair 234 and is then ejected from the second sheet-set ejection port.

Whereas description has been made regarding the operations of the folding process and the stapling process, an aligned and stacked sheet set can be ejected as it is (without being subjected to the folding process or stapling process).

As described above, according to the sheet processing apparatus of the present embodiment, at least the part (curved path 224) of the sheet-set conveyance path where the folding roller pair 231 and the pushing plate 232 that constitute the sheet-set folding device is formed into the curved shape. This enables effectively using the intra-apparatus space and miniaturization of the apparatus and space saving without causing ineffective use of spacing.

In addition, the sheet-set folding device has the pushing plate 232 and folding roller pair 231 for folding the sheet set. The curved path 224 is formed into the predetermined arc shape. The pushing plate 232 is disposed inside of the sheet-set conveyance path (curved path 224) curvedly formed into the predetermined arc shape and concurrently disposed perpendicular to the tangential line of the curved path 224 and on the center line thereof. Accordingly, spaces in both the height and horizontal directions of the apparatus can be reduced, and the spacing can be efficiently used, so that the miniaturization of the apparatus and space saving can be achieved without causing ineffective use of spacing. Further, when the sheet set in the curved path 224 is pushed by the pushing plate 232, the spacing can be efficiently used, the sheet set is bent curvedly in the extending direction along the direction of pushing by the pushing plate 232 (curvedly bent along the curved path 224), the sheet set becomes easily foldable. Consequently, the sheet set can be folded at a lower force, so that the driving source for the pushing plate 232 can be miniaturized and costs can be reduced.

Further, either in operation with the folding process being performed or in operation without the folding process being performed, the operation can be performed commonly using the processing tray 223, so that corresponding to spacing and costs can be reduced.

Thus, according to the configuration formed as described above, the sheet processing 201 is miniaturized. Thereby, the sheet processing apparatus 201 can be disposed above the sheet processing apparatus 201. This enables the reduction in the installation occupation area (space saving) of the overall apparatus. Further, the sheet processing apparatus 201 can be disposed above the image forming portion 214 and below the scanner portion 203, thereby similarly enabling reduction in the installation occupation area (space saving) of the overall apparatus.

(Second Embodiment)

Figure 5:
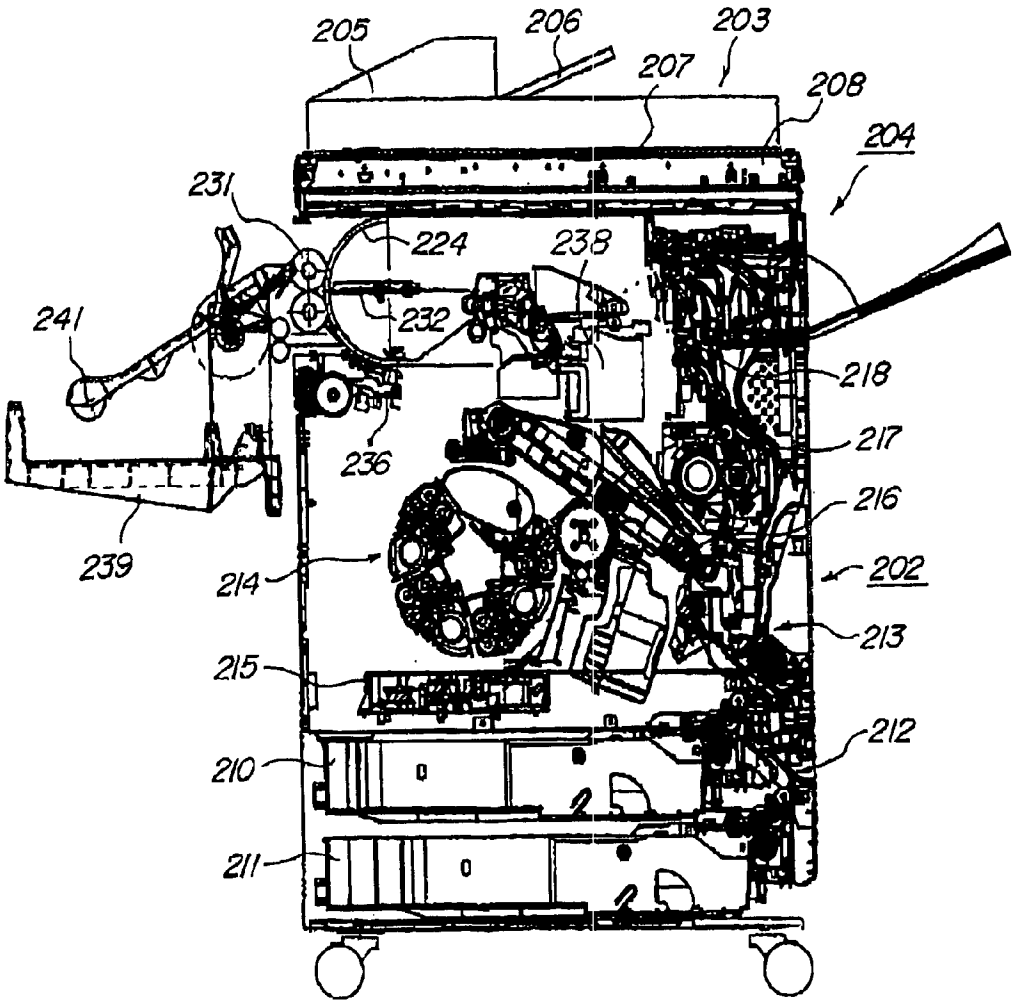
FIG. 5 is an overall front cross section of an image processing according to a second embodiment of the invention.
Figure 6:
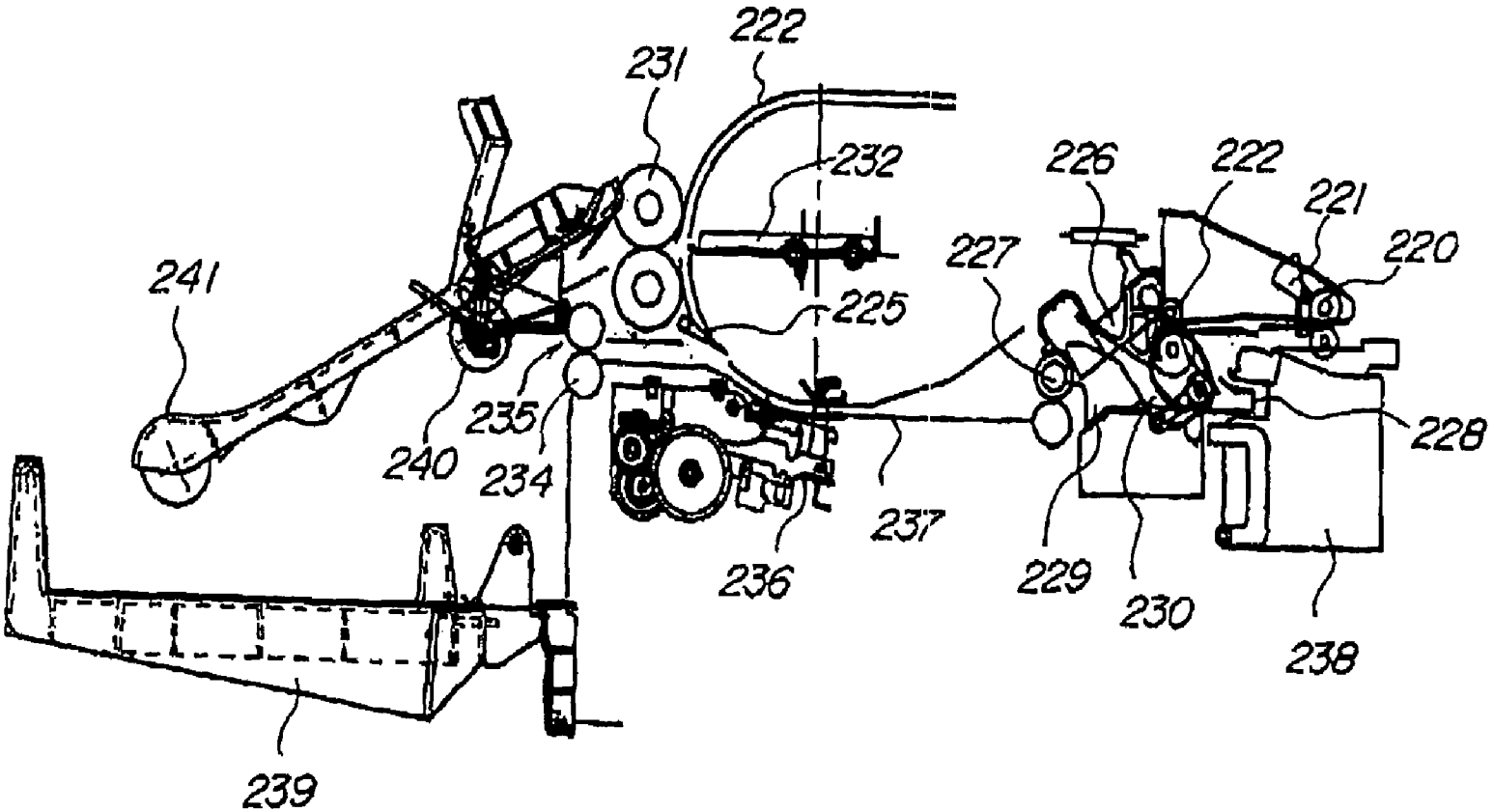
FIG. 6 is a schematic front cross section of a sheet processing apparatus according to the second embodiment of the invention.

Referring to FIGS. 5 and 6, a sheet processing apparatus and an image processing apparatus according to a second embodiment of the invention will be described herebelow. FIG. 5 is an overall front cross section of the image processing apparatus; and FIG. 6 is a schematic front cross section of the sheet processing apparatus.

The second embodiment shown in FIGS. 5 and 6 is different from the first embodiment in that, in addition to a first stapling unit 236, a second stapling unit 238 is disposed on the sheet-tail-edge side of the processing tray 223. The additional provision is effective, for example, to increase the number of single-side bindable sheets by 50, 100, . . . pieces. More specifically, a degree of freedom occurs for setting the first stapling unit 236, which is to be used in the folding process, and the number of staples formed by the stapling unit 236. Thereby, products optimized in cost and specification can be provided to users.

In addition, the second embodiment, which is shown in FIGS. 5 and 6, is different from the first embodiment in that a stack tray 239 is disposed on an apparatus sidewall on the sides of the sheet-set ejection ports 233 and 235. A folding-processed sheet set is ejected and stacked on the stack tray 239 through an ejection roller pair 240 that is rotated by a saddle ejection motor (not shown). A sheet-set presser member 241 for press-holding a bi-folded sheet set is pivotably provided above the ejection roller pair 240. When a folding-processed sheet set is ejected by the ejection roller pair 240 onto the stack tray 239, the sheet-set presser member 241 press-holds an edge portion of the sheet set, thereby enabling the folding-processed sheet set to be stacked on the tray without being unfolded. Other portions of the configuration and operations are similar to those of the first embodiment, and component members having functions equivalent to those of the first embodiment are shown with the same reference numerals.

In the respective embodiment described above, although the copier is exemplified for the image processing apparatus, the invention is not limited thereto. The image processing apparatus may be of a different type, such as a scanner, printer, or facsimile machine, or combined apparatus thereof. Alternatively, the apparatus may be an image processing apparatus that uses a transfer-medium carrying unit and performs image transfer by serially superposing individual color toner images on the transfer medium being carried by the transfer-medium carrying unit. In any of the cases, effects similar to those described above can be secured by adapting the present invention to a sheet processing being used in the image processing apparatus.

In addition, whereas the respective embodiment has been described and shown with reference to the exemplary sheet processing apparatus attachable to and detachable from the image processing apparatus, the present invention is not limited thereto. The present invention may be adapted to a sheet processing apparatus integrated with an image processing apparatus. In this case also, similar effects can be secured by adapting the present invention to the sheet processing.

Further, in the respective embodiment described above, although an electro-photographic method is exemplified as being a recording method, the present invention is not limited thereto. For example, the present invention may be adapted to an apparatus employing a different recording method, such as an inkjet method.

(Third Embodiment)

Figure 7:
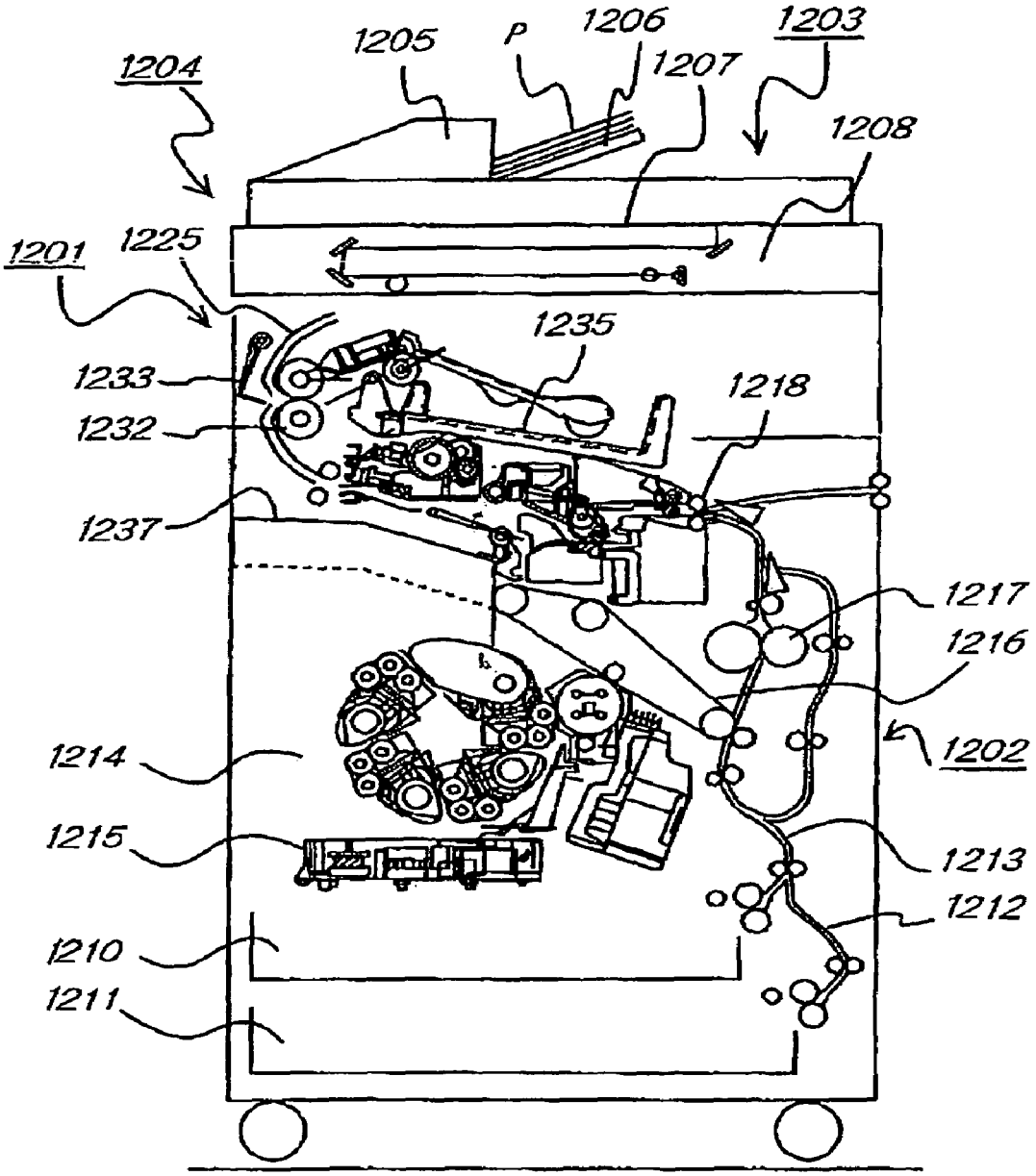
FIG. 7 is a schematic front cross section of an image processing according to a third embodiment of the invention.
Figure 8:
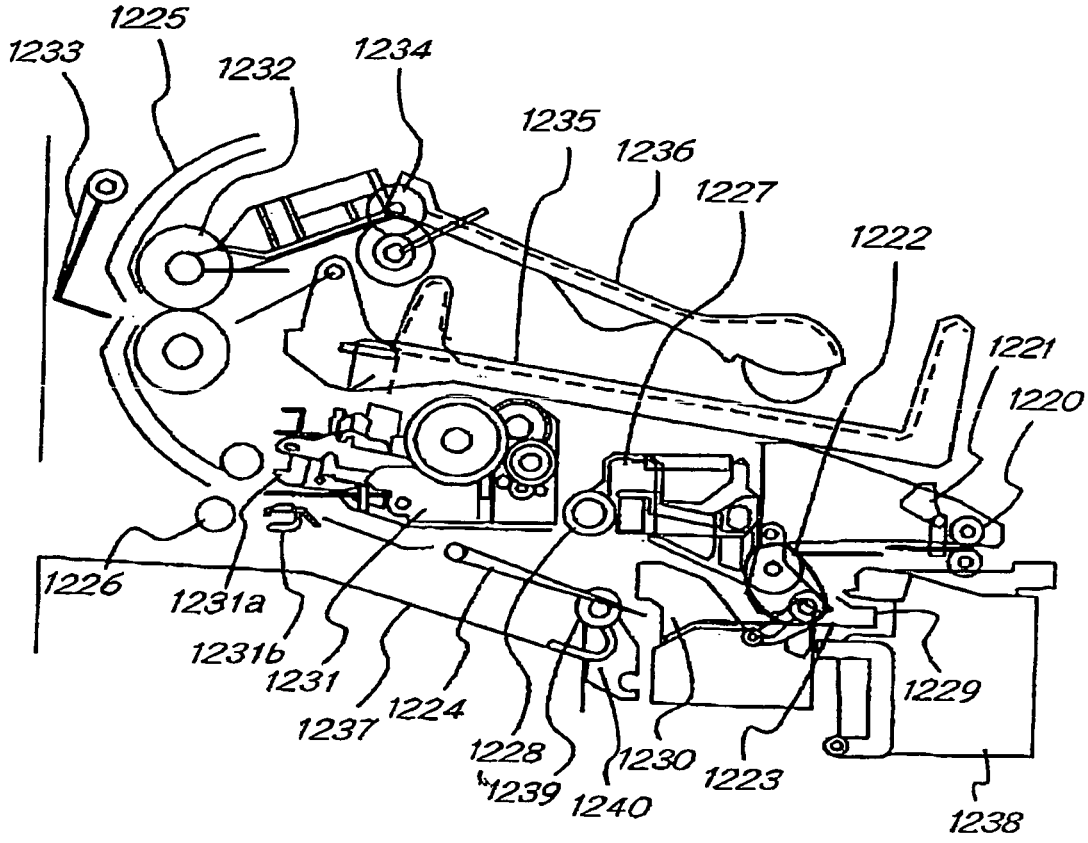
FIG. 8 is a schematic front cross section of a sheet processing apparatus according to the third embodiment of the invention.

Referring to the drawings, the following will describe a sheet processing apparatus and a copier as being an example of an image processing apparatus having the sheet processing apparatus in a mainbody of its own, according to a third embodiment of the present invention. FIG. 7 is an overall front cross section of the image processing apparatus; FIG. 8 is a schematic front cross section of the sheet processing apparatus; FIGS. 9A to 9D are views descriptive of operation of a folding process; and FIGS. 10A to 10C are views descriptive of operation of a stapling process of the sheet processing apparatus.

The image processing apparatus according to the present embodiment a copier 1204. In the copier 1204, a printer 1202 having an image forming portion is disposed in a lower portion, a scanner 1203 having an image reading portion is disposed above the sheet processing apparatus 1201, and a sheet processing apparatus 1201 is disposed therebetween. Thus, the sheet processing apparatus 1201 is disposed above the printer 1202 and below the scanner 1203. The sheet processing apparatus 1201 can be mounted not only in a copier of the above-described type, but also in any one of a facsimile machine, printer, and combined apparatus thereof, for example.

The scanner portion 1203 is provided with a readout sheet feeder 1205. An original sheet P set on an original-sheet tray 1206 is conveyed to an original-sheet readout position on an original-sheet platen glass 1207, and the original sheet is read out by an optical system 1208. An image having been read out is conveyed to the printer 1202.

Below the mainbody of the printer 1202, there are mounted a plurality of sheet stock portions 1210 and 1211 on which, for example, sheets of different sizes are stacked, and a sheet feeding portion 1212 for feeding one sheet at a time from sheets stacked on the sheet stock portions 1210 and 1211. A sheet S fed by the sheet feeding portion 1212 is conveyed to an image forming portion 1214 through a sheet conveyance path 1213. In a laser scanner 1215, laser light is scanned accordance with image information read out by the optical system 1208 of the scanner portion 1203, and a latent image (toner image) is formed onto a photoreceptor belt 1216 (photoreceptor drum, depending on the case) of the image forming portion 1214. The toner image thus formed on the photoreceptor belt 1216 is transferred onto a sheet S, and the sheet S is conveyed by a conveyance roller pair 1218 through a transfix member 1217 that causes a toner image on a sheet to be plastically fused and transfixed to the sheet.

As shown in FIG. 8, in the sheet processing apparatus 1201, the sheet S conveyed from the printer 1202 is accepted by an entry roller pair 1220, and then conveyed to a conveyance roller pair 1222. A sheet detection sensor 1221 for detecting the passing of the sheet S in transit is provided near the entry roller pair 1220. In this case, control is performed such that when the sheet tail edge is being passed through the sheet detection sensor 1221, the sheet S is ejected at a predetermined velocity from the conveyance roller pair 1222. The ejected sheet S is stacked on a processing tray 1223 serving as a sheet stack portion, which allows a predetermined number of sheets to be stacked, and is aligned.

(Operation of Folding Process)

Figure 9:
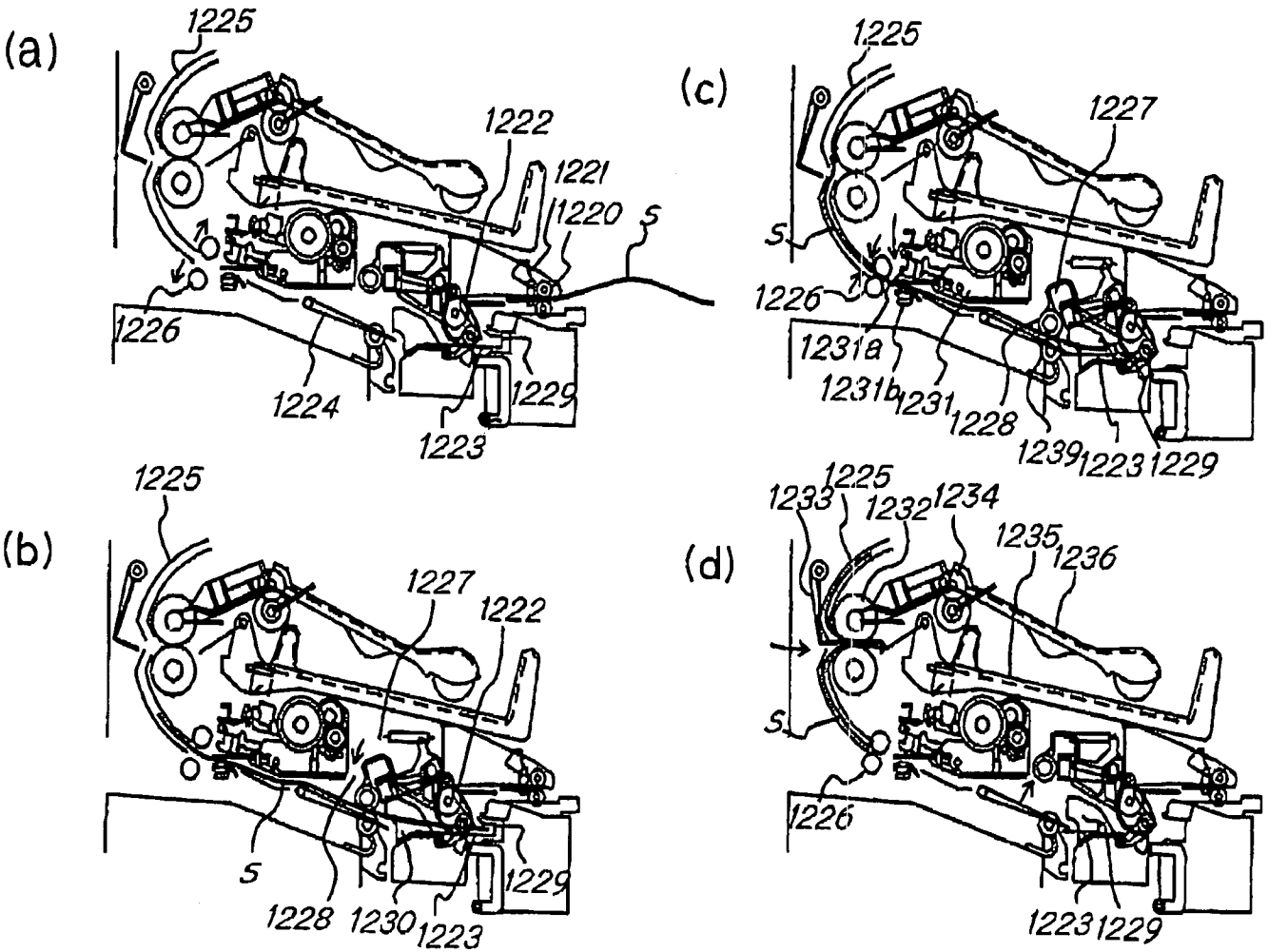
FIGS. 9A to 9D are views descriptive of operation of a folding process in the third embodiment.
Figure 10:
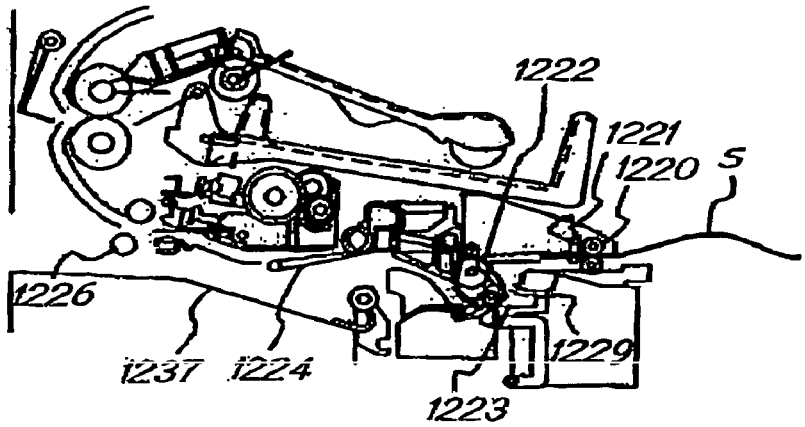
FIGS. 10A to 10C are views descriptive of operation of a stapling process in the third embodiment.
Figure 10:
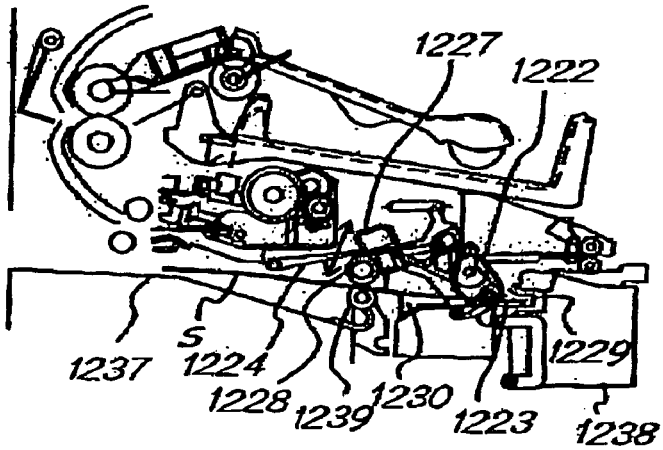
Figure 10:
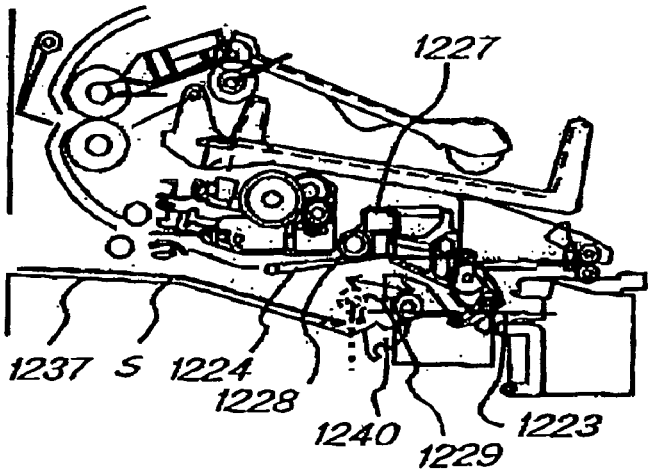

Referring to FIGS. 8 and 9, the configuration of the sheet processing apparatus 1201 will be described along with operation in the event of the folding process. The folding process is a process that performs stapling in a conveyance-direction central position of a set of sheets (or, a sheet set), and performing folding of the set of sheets along the central position in two (or, bi-folding the set of sheets along the central position). A saddle unit for performing the folding process is configured primarily of an curved path 1225 that constitutes a sheet-set conveyance path, and a folding roller pair 1232 and a pushing plate 1233 that constitute a sheet-set folding device. A combination of the processing tray 1223 and the curved path 1225 is equivalent to the saddle tray (tray on which the sheet alignment is performed for the folding process) of the conventional example.

With reference to FIG. 9A, a sheet S conveyed to the sheet processing apparatus 1201 is ejected onto the processing tray 1223, which is formed substantially horizontal and straight, when the tail edge of the sheet passes away from the conveyance roller pair 1222. In the folding process, a switching flapper 1224 serving as a conveyance-path switching member is disposed on a downstream side of the processing tray 1223. When performing the folding process, the switching flapper 1224 takes a posture, as shown in the drawing, thereby to form the conveyance path, and guides to the curved path 1225 the sheet conveyed from the processing tray 1223. A sheet-set conveyance roller pair 1226 provided in the curved path 1225 is detachable by a driving means (solenoid or the like), and is preliminarily put into a detached state before the sheet is ejected.

Then, with reference to FIG. 9B, a pivotal arm 1227 with one end being rotatably supported pivotally moves in the lower direction. The sheet is conveyed by a return roller 1228 rotatably supported by the pivotal arm 1227 until it abuts a rear end stopper 1229, whereby the alignment operation in the sheet conveyance direction is terminated. Then, with an aligning plate 1230 (which may be provided in two, from and inner portions) movable in a front-inner direction as viewed in the drawing (both left and right as viewed from the conveyance direction), alignment of the sheet in the front-inner direction is carried out. On this occasion, when the processing tray 1223 is substantially horizontal, a case can occur in which the sheet is tilted in alignment by the aligning plate 1230, so that the sheet alignment in the conveyance direction is again carried out by the return roller 1228. In this manner, sheet-set alignment terminates.

Upon termination of the sheet-set alignment as described above, as shown in FIG. 9C the rear end stopper 1229 is moved by moving means (not shown) in the conveyance direction (arrow-indicating direction), whereby the sheet set S is moved by a predetermined amount. Thus, the rear end stopper 1229 concurrently constitutes a sheet-set conveyor. Then, the sheet set is stapled by a stapling unit 1231 along a central position (binding position). The stapling unit 1231 is formed separated into a stapling portion 1231*a* and a clincher portion 1231*b* that clinches staple legs, and is disposed with a sheet-set conveyance path being interposed therebetween. Two stapling units 1231 are disposed (shown overlapped in the drawing) in positions left-right symmetric with respect to a sheet-width-direction center. The sheet set is bound by being stapled at two portions along the sheet central position. The respective stapling unit 1231 is supported movably in the front-inner direction, and is placed in a standby state corresponding to the sheet size. Thus, the respective stapling unit 1231 is disposed above the printer 1202 and inside of the image forming portion 1214, so that the reduction in the installation occupation area of the overall apparatus can be implemented.

Subsequently, as shown in FIG. 9D, the rear end stopper 1229 is further moved by a stopper moving motor (not shown) in the left direction as viewed in the drawing. Thereby, the sheet set S is carried to an upper portion from a lower portion (i.e., vertically upward) along the curved path 1225 formed into a predetermined arc shape. In addition, a folding roller pair 1226 closes, pinches the sheet set, and conveys the sheet set to the folding roller pair 1232 and the pushing plate 1233 that constitute a sheet-set folding device. The sheet set S is carried vertically upward along the curved path 1225 formed into the predetermined arc shape. Then, the sheet set is moved until the binding position of the sheet set opposes a nip position of the folding roller pair 1232.

Upon termination of the movement, the central portion (binding position) of the sheet set is pushed by the pushing plate 1233. The pushing plate 1233 is a planar member extending in the sheet width direction, and is formed by being bent into a substantially L shape in cross section with one end being rotatably journalled so as to be rotationally driven by a driving means (such as a solenoid) (not shown). With the rotation of the pushing plate 1233, the other end not journalled is driven to push an curved portion of the curved path 1225 in a normal direction. While the internal sheet set is being folded, the sheet set is pushed out to the nip of the folding roller pair 1232. Then, the sheet set is nipped and pinch-conveyed by the folding roller pair 1231 to be bi-folded. Thereby, the sheet set is bi-folded along the central binding position in the sheet length direction. Thus, although the pushing plate 1233 is disposed outside of the curved path 1225, the pushing plate 1233 is formed into the substantially L shape in cross section to pivotally move whereby to push the sheet set. Consequently, the apparatus can be miniaturized and hence the installation occupation area can be reduced in comparison to the case where the pushing plate is provided to the conventional substantially vertical saddle tray.

The folding-processed sheet set is ejected and stacked on a stack tray 1235, which is provided as a first tray, through an ejection roller pair 1234. The stack tray 1235 is disposed inside of the curved path 1225; more specifically, the stack tray 1235 is disposed above the processing tray 1223 and aside the saddle unit (the curved path 1225, the folding roller pair 1232, and the pushing plate 1233). A sheet-set presser member 1236 for press-holding a bi-folded sheet set is pivotably provided above the ejection roller pair 1234. The sheet-set presser member 1236 press-holds an edge portion of the sheet set ejected onto the stack tray 1235, thereby preventing the folding-processed sheet set from being unfolded.

R of the curved path 1225 is set to $\pi R \geqq L$ (L=length of the bi-folded sheet S in the sheet conveyance direction), and the length of a straight portion of the processing tray 1223 is set to $L2 \geqq L$. The sheet length prior to the bi-fold bookbinding is expressed as $2L(2 \times L)$. These settings make it possible to prevent a sheet leading edge from being broomed down during sheet alignment and to implement improved alignment. While the conditions described above are preferred, but no limitations are imposed thereto.

In addition, as shown in FIG. 8, the curved path 1225 is bent curvedly in the reverse direction (W-shaped) in the position where the sheet set is pushed by the pushing plate 1233. Thereby, a preliminary folding pattern can be provided to the sheet set, folding thereof is further facilitated; however, the present invention is not limited thereto.

Further, the sheet set is aligned on the straight path (processing tray), and is pushed by the rear end stopper 1229 thereby to be carried vertically upward. This enables preventing an intra-sheet-set misalignment from occurring when the sheet set is carried by a roller pair (such as a diagonal misalignment can be prevented that occurs when a central sheet of the sheet set advances faster than other ones). In addition, the sheet set is carried vertically upward, whereby the sheet-set tail edge is always brought by the sheet-set dead weight into abutment with the rear end stopper 1229. Consequently, stapling can be performed in a state where the sheet-set alignment is not broken.

Thus, the alignment is achieved by using the processing tray 1223 having the substantially horizontal straight shape, and the sheet-set is conveyed by being carried vertically upward along the curved path 1225, whereby an urging force occurring from the sheet-set dead weight is obtained. According to this configuration, spaces in both the height and lateral directions of the apparatus can be reduced, and a compromise of space saving (reduction in the installation occupation area) and securing of alignment can be efficiently implemented.

Further, the stack tray 1235 serving as the first tray to stack folding-processed sets of sheets can be disposed above the sheet processing apparatus, and both the saddle unit for performing the folding process and the stack tray 1235 can be accommodated within the width of the image forming apparatus. Thereby, the sheet processing apparatus can be mounted above the imaging forming portion, not on the sidewall of the mainbody of the image forming apparatus. Consequently, the installation occupation area can be reduced without increasing the width of the sheet processing apparatus.

(Operation of Stapling Process)

The configuration of the sheet processing apparatus 1201 will be described herebelow along with operation of the stapling process of the sheet processing apparatus 1201 with reference to FIGS. 8 and 10A to 10C. The stapling process is defined to perform only stapling and not to perform the folding process.

As shown in FIG. 10A, also when performing the stapling process, as in the stapling process, a sheet S conveyed to the sheet processing apparatus 1201 is ejected onto the processing tray 1223, which is formed substantially horizontal and straight, when the tail edge of the sheet passes away from the conveyance roller pair 1222. A difference therefrom is that the switching flapper 1224 takes the posture shown in FIG. 10A whereby to form the conveyance path, and guides to a stack tray 1237 that is used to stack a sheet or sheet set not folding processed. The stack tray 1237 is substantially horizontal and vertically movable by a driving means (not shown)(see FIG. 7).

As shown in FIG. 10B, a sheet ejected onto the processing tray 1223 is returned by the return roller 1228 to the rear end stopper 1229. In this manner, the sheet is aligned on the processing tray 1223 (see FIGS. 9A and 9B). Upon termination of the sheet-set alignment, stapling is performed by a stapling unit 1238 along an edge portion of the sheet set. Then, the pivotal arm 1227 again pivotally moves in the vertical direction thereby to cause the return roller 1228 to perform a reverse rotation (inherent rotation in the conveyance direction), whereby the sheet set is carried in the direction of the stack tray 1237. When the tail edge of the set of sheets is moved by a predetermined amount from a nip of a roller 1239, conveyance of the sheet set is terminated.

Subsequently, as shown in FIG. 10C, a second rear end stopper 1240 is rotated and retracted in the direction of leaving the stack tray 1237 with substantially the same timing as that when the return roller 1228 is upwardly retracted, whereby the tail edge of the set of sheets is caused to fall on the stack tray 1237. Then, the second rear end stopper 1240 is immediately rotated toward the stack tray 1237 thereby to return from the retracted state, whereby the sheet set is aligned. In this manner, the sheet set is stacked over the stack tray 1237.

As described above, the configuration is formed such that the alignment operations in the folding process and the stapling process are performed using the common processing tray 1223. Consequently, the intra-apparatus space and manufacturing costs can be reduced.

The configuration of the second rear end stopper 1240 and the ejection control as described above are intended to implement space-saving stacking of sheets by using the substantially horizontal stack tray 1237. As such, in such a case that a predetermined tilt can be provided to the stack tray 1237, the sheet set may be ejected by the return roller 1228 onto the stack tray 1237 without the above-described control being performed.

(Fourth Embodiment)

Figure 11:
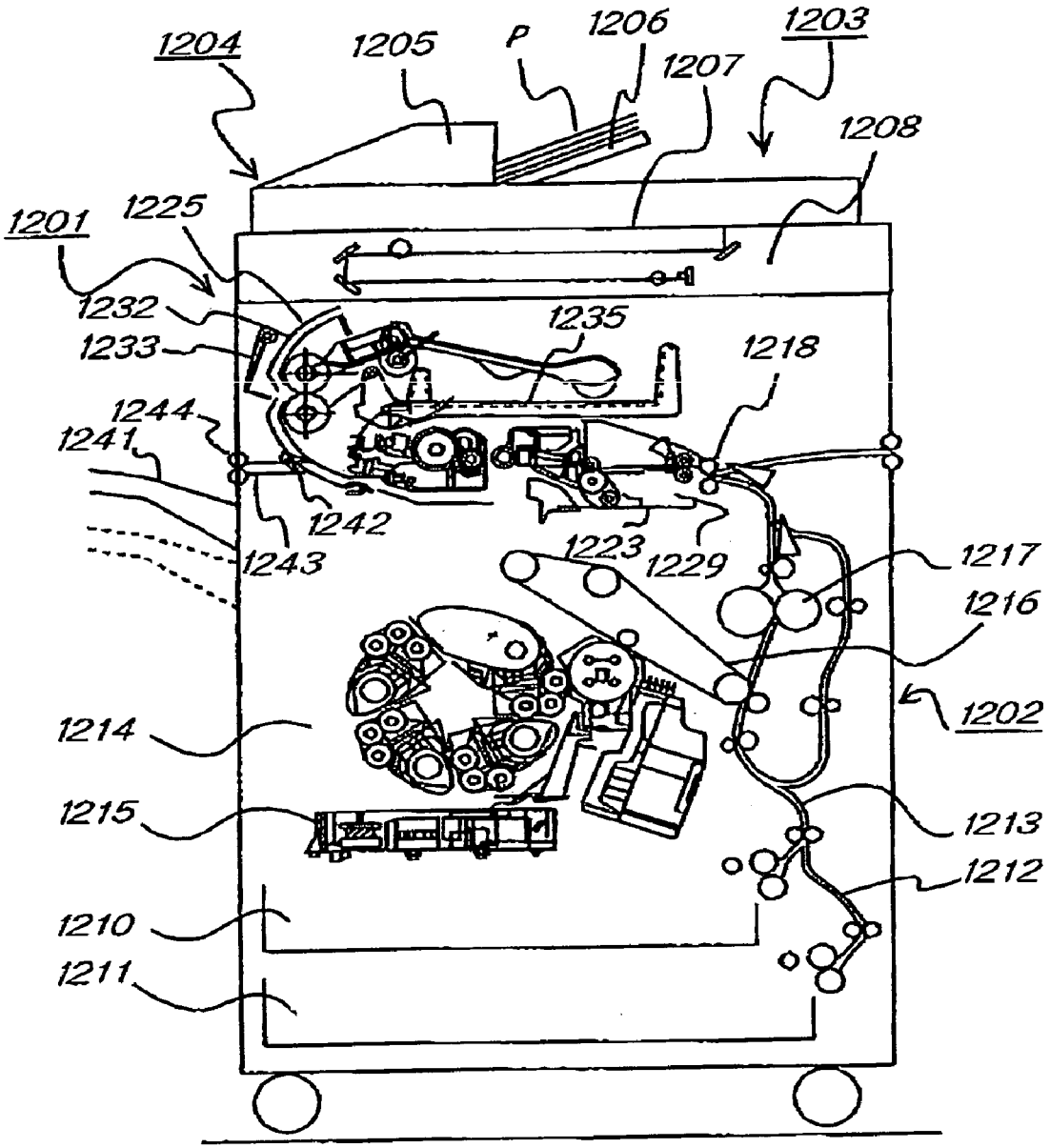
FIG. 11 is a schematic font cross section of an image processing apparatus according to a fourth embodiment of the invention.
Figure 12:
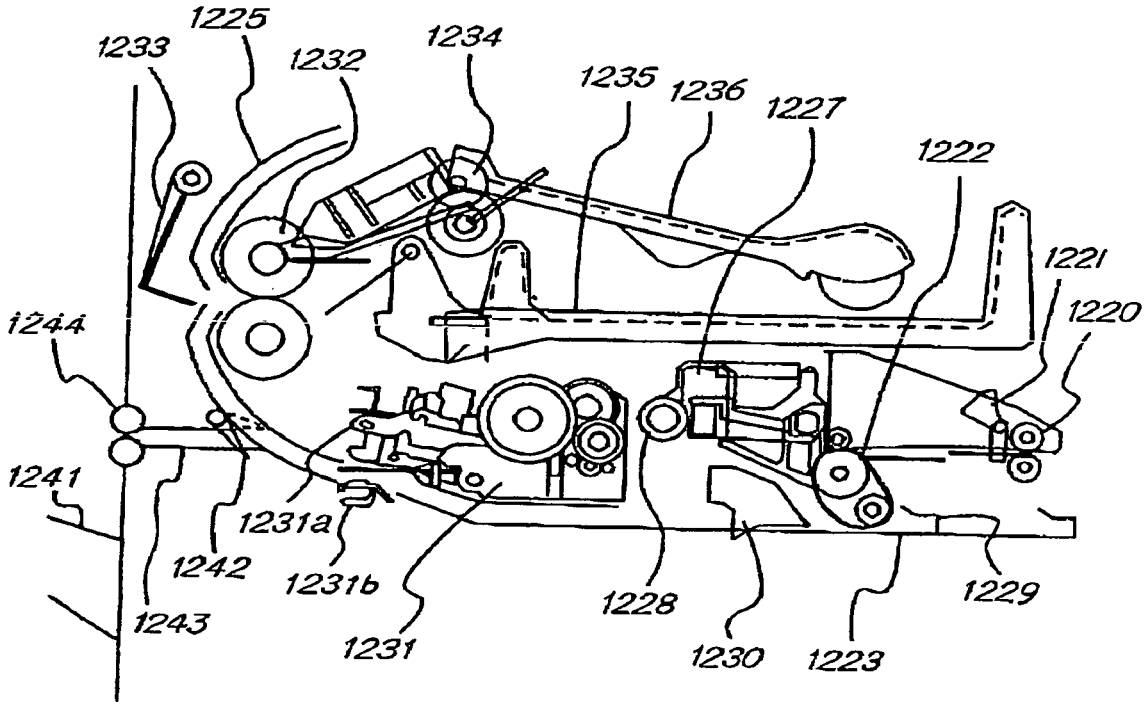
FIG. 12 is a schematic front cross section of a sheet processing apparatus according to the fourth embodiment of the invention.
Figure 13:
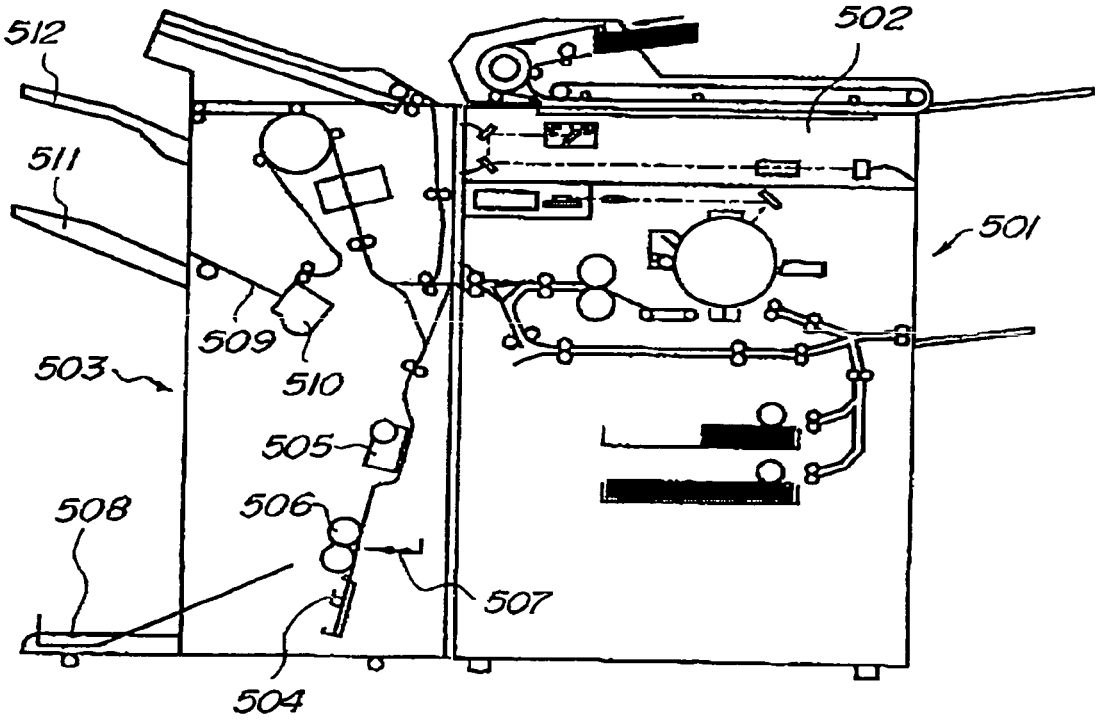
FIG.13 (PRIOR ART)
FIG. 13 is a view showing an example of a conventional image processing apparatus (prior art).

The following will describe a sheet processing apparatus and an image forming apparatus according to a fourth embodiment of the present invention. FIG. 11 is a schematic front cross section of an image processing apparatus; and FIG. 12 is a schematic front cross section of the sheet processing apparatus.

According to the third embodiment, the stack tray 1237 serving as the second tray for stacking the sheet or sheet set not folding-processed (that is, a single-side bound set or not-bound sheet set) is provided below the saddle unit in the apparatus mainbody. However, in the present embodiment, a stack tray 1241 serving as a second tray is provided outside of the image forming apparatus. The stack tray 1241 is configured vertically movable by a driving source (not shown).

In addition, in the configuration, an ejection-switching flapper 1242 is provided downstream of the stapling unit 1231, and sheets can be ejected to the outside of the apparatus from an ejection roller pair 1244 provided in an ejection path 1243.

Thus, since the stack tray 1241 is provided outside the apparatus, the number of stackable sheets on the stack tray 1241 for single-side bound sets or not-bound sheet sets can be increased.

Further, the stapling unit 1231 used for the folding process can be used also in the event of single-side binding. As such, the second stapling unit 1238 can be avoided, and in addition, the movement area of the rear end stopper 1229 can be increased. Consequently, simplification in mechanism and reduction in manufacturing costs can be implemented since the stapling unit is sharedly used and no additional stapling unit is necessary.

This application claims priority from Japanese Patent Application No. 2003-386395, filed Nov. 17, 2003; and Japanese Patent Application No. 2003-386397, filed Nov. 17, 2003, which are hereby incorporated by reference herein.

What is claimed is:

1. A sheet processing apparatus comprising:

a sheet stack portion on which sheets are stacked;

a sheet folding device which folds the sheets, the sheet folding device having a pushing plate and a folding roller pair, the folding roller pair is disposed outside of a curved path, which folds the sheets by nipping, and the pushing plate is disposed inside of the curved path, which pushes the sheets to the folding roller pair;

a first sheet ejection path which ejects the sheets for which the folding process has been performed by the sheet folding device;

a second sheet ejection path which ejects the sheets for which the folding process has not been performed by the sheet folding device;

a sheet conveyor which conveys the sheet stacked on the sheet stack portion to the first sheet ejection path or the second sheet ejection path;

a switching flapper switchable to guide the sheet to the first sheet ejection path or the second sheet ejection path; and a staple unit which performs a binding process for the sheets by using a staple, wherein the first sheet ejection path has the curved path, the sheet folding device folds the sheets at a curved portion of the curved path, and the switching flapper is disposed on a downstream side of the staple unit in a sheet conveyance direction.

2. A sheet processing apparatus according to claim 1, wherein the pushing plate is disposed perpendicular to a tangential line of the curved portion.

3. A sheet processing apparatus according to claim 1, wherein at least a portion of the sheet stack portion is substantially horizontal.

4. An image processing apparatus comprising:

an image forming portion which forms an image on a sheet; and a sheet processing apparatus according to anyone of claims 1, 2 and 3 for performing a process on the sheet on which the image has been formed, wherein the sheet processing apparatus is disposed above the image forming portion.

5. An image processing apparatus comprising:

an image reading portion which reads an original image;

an image forming portion which forms an image on a sheet in accordance with image information from the image reading portion; and a sheet processing apparatus according to anyone of claims 1, 2 and 3 which performs a process on the sheets on which the images have been formed, wherein the image reading portion is disposed above the image forming portion, and the sheet processing apparatus is disposed between the image forming portion and the image reading portion.

* * * * *

UNITED STATES PATENT AND TRADEMARK OFFICE

CERTIFICATE OF CORRECTION

PATENT NO. : 7,152,856 B2 
APPLICATION NO. : 10/987007
DATED : December 26, 2006
INVENTOR(S) : Daisaku Kamiya et al.

It is certified that error appears in the above-identified patent and that said Letters Patent is hereby corrected as shown below:

ON THE TITLE PAGE AT ITEM (56), RC:
U.S. Patent Documents, "2004/0022564 A1 2/2004 Fujil et al." should read --2004/0022564 A1 2/2004 Fujii et al.--.

COLUMN 1:
Line 9, ""com-" should read --("com---.

COLUMN 2:
Line 57, "processing" should read --processing apparatus--.

COLUMN 3:
Line 2, "processing" should read --processing apparatus--.
Line 8, "processing" should read --processing apparatus--.
Line 17, "font" should read --front--.

COLUMN 7:
Line 3, "sheet set" should read --sheet-set--.

COLUMN 10:
Line 27, "from" should read --front--.

COLUMN 14:
Line 36, "anyone" should read --any one--.
Line 45, "anyone" should read --any one--.

Signed and Sealed this

Twenty Second Day of April, 2008

JON W. DUDAS
*Director of the United States Patent and Trademark Office*